US005879137A

United States Patent [19]

Yie

[11] Patent Number: 5,879,137

[45] Date of Patent: Mar. 9, 1999

[54] METHOD AND APPARATUS FOR PRESSURIZING FLUIDS

[75] Inventor: Gene G. Yie, Auburn, Wash.

[73] Assignee: Jetec Corporation, Auburn, Wash.

[21] Appl. No.: 787,089

[22] Filed: Jan. 22, 1997

[51] Int. Cl.[6] ..... F15B 13/07

[52] U.S. Cl. ..... 417/225; 91/36; 91/39; 91/524; 137/624.13; 137/624.18; 417/225; 417/347

[58] Field of Search ..... 91/36, 39, 524; 137/624.13, 624.18; 417/225, 347

[56] References Cited

U.S. PATENT DOCUMENTS

| | | | |
|---|---|---|---|
| 1,763,154 | 6/1930 | Holzwarth | 137/624.13 X |
| 2,100,154 | 11/1937 | Ashton | 137/624.13 |
| 2,398,542 | 4/1946 | Light | 137/624.13 X |
| 2,477,590 | 8/1949 | Ferwerda | 137/624.13 X |
| 2,818,881 | 1/1958 | Bonner et al. | 137/624.13 X |
| 2,970,571 | 2/1961 | Pecchenino | 137/624.13 X |
| 3,348,495 | 10/1967 | Orshansky | 91/480 X |
| 4,277,229 | 7/1981 | Pacht | 417/539 X |
| 4,534,427 | 8/1985 | Wang et al. . | |
| 4,551,077 | 11/1985 | Pacht | 417/539 X |
| 4,555,872 | 12/1985 | Yie . | |
| 4,611,973 | 9/1986 | Birdwell | 417/347 X |
| 4,621,988 | 11/1986 | Decker | 417/347 X |
| 5,092,362 | 3/1992 | Yie . | |
| 5,117,872 | 6/1992 | Yie . | |
| 5,186,393 | 2/1993 | Yie . | |
| 5,241,986 | 9/1993 | Yie . | |
| 5,297,777 | 3/1994 | Yie . | |
| 5,524,821 | 6/1996 | Yie et al. . | |

*Primary Examiner*—Gerald A. Michalsky
*Attorney, Agent, or Firm*—Speckman Pauley Petersen & Fejer

[57] ABSTRACT

A high-pressure valve assembly having a valve body that defines a preferably cylindrical valve cavity, a fluid inlet, a fluid outlet and a plurality of valve ports; and a fluid pressure intensifier assembly having a plurality of piston-plunger assemblies and utilizing the high-pressure valve assembly to distribute the working fluid. The valve assemblies have a valve rotor rotatably mounted within the valve cavity. In one embodiment, the valve rotor divides the valve cavity into a high-pressure region in communication with the fluid inlet and a low-pressure region in communication with the fluid outlet. As the valve rotor rotates, at least one and preferably three or more valve ports communicate with the power chamber and at least one and preferably three or more valve ports communicate with the discharge chamber. The valve cage has a high-pressure region in communication with the fluid inlet, a low-pressure region in communication with the fluid outlet, and valve ports in communication with the corresponding valve rod holes and the valve port of the valve body. In such second embodiment, the valve rotor has a slanted face in contact with a round end of each valve rod while the opposite end of each valve rod is biased by a spring or a pressurized gas. As the valve rotor rotates, the valve rods slide in an axial direction within the valve rod holes. As the valve rod oscillates, the middle cutout area forms communication with the respective valve port, alternatively with the high-pressure region and the low-pressure region.

7 Claims, 13 Drawing Sheets

METHOD AND APPARATUS FOR PRESSURIZING FLUIDS

BACKGROUND OF THE INVENTION

Fluid power systems are widely used in the industry for performing various types of work, such as generating high-velocity fluid jets. One important component of all fluid power systems is the pump through which the system fluid is pressurized and delivered. A variety of conventional mechanical components are used inside the pump to pressurize fluids and an electric motor, an engine, or another fluid power system typically provides the required energy. A pump is basically a device for converting kinetic energy from a prime mover to the potential energy stored in pressurized fluid, or for raising the potential energy from one fluid to another fluid by adding kinetic energy.

Conventional types of pumps have various names. The names often identify a mode of operation, method of pressurization or appearance of the pump. Common types of conventional pumps include centrifugal pumps, diaphragm pumps, roller pumps, vane pumps, bellows pumps, tubing pumps, screw pumps, piston pumps, crankshaft pumps, positive displacement pumps, and pressure intensifiers. At relatively low operating fluid pressures, there are many types of conventional pumps available and the design is often dictated by considerations such as fluid compatibility, cost and size. At relatively high operating fluid pressures, there are fewer types of conventional pumps available. At operating pressures above about 1,000 psi, there are only a few types of conventional pumps that can withstand the stresses involved and that are capable of producing the required pressures. At relatively high fluid pressures, such as above 10,000 psi, suitable conventional pumps are restricted to the so-called positive-displacement reciprocating pumps that involve constant speed moving pistons to move a fixed volume of fluid through a set of check valves and into the delivery line. Such conventional pumps may also be identified as axial-piston pumps, radial-piston pumps, and crankshaft pumps to denote the arrangement of the multiple pistons or plungers involved.

A conventional crankshaft pump is normally a multiple-piston pump that uses a crankshaft to impart linear movement to a set of pistons, such as those of known automotive engines. A conventional triplex pump has three cylinders or pistons; a quintuplex pump has five cylinders or pistons. Conventional crankshaft pumps are generally directly driven with electric motors or engines, normally at a rotating speed of about 500 rpm. A conventional crankshaft pump is shown in FIG. 1.

A conventional pressure intensifier is a piston pump that is driven with pressurized fluid, such as hydraulic fluid or another suitable working fluid, through a piston-plunger arrangement to raise the pressure of another fluid, the system fluid. The term pressure intensifier often implies that there are two separate fluids and fluid systems involved. The additional energy required is provided by a motor or engine of the working fluid system. Fluid pressure intensifiers are commonly used in generating relatively high-pressure waterjets at static pressures above about 40,000 psi. These intensifiers are often a double-acting type with two opposing plungers connected to a single power piston, which reciprocates within a cylinder as a result of pressurized hydraulic fluid alternatively entering the two sides of the power piston. Two piston position sensors and a pilot-operated 4-way hydraulic valve are conventionally used to regulate and control flow of a working fluid. The plungers, which often have a smaller cross-sectional area than the power piston, move the system fluid in and out of the high-pressure cylinders, through inlet and outlet check valves. An intensification ratio is defined as the area ratio of the power piston to the plunger, which determines a maximum pressure that the system fluid can attain inside a particular pressure intensifier. A conventional double-acting pressure intensifier is shown in FIG. 2.

The performance of a high-pressure pump is generally rated or defined by a peak-pressure capability, an efficiency, power characteristics, reliability, operating flexibility and cost. Key or primary components of high-pressure pumps include check valves, pistons, plungers, piston seals, and high-pressure cylinders. Because of the relatively high-frequency cyclic pressure pulsations and high internal stresses, these pumps parts are subjected to metal fatigue problems that result in premature fracture of metal parts. Reliability of these pump parts are very important to pump manufacturers and pump users.

Conventional crankshaft pumps are quite popular because of their direct-driven nature and rugged construction, and are used in many outdoor applications, such as irrigation and oil field operations. But they also have well-known shortcomings. Conventional crankshaft pumps generate relatively high vibrations due to the geometry of piston arrangement. For example, conventional triplex crankshaft pumps experience considerable output pressure pulsations due to their power distribution through only three cylinders. A quintuplex pump has improved pressure pulsation but is also bulkier and heavier because of the two additional cylinders. Crankshaft pumps are generally limited to a peak pressure of about 20,000 psi, due to metal-fatigue problems associated with the fluid manifold, which is often made of a monolithic block of stainless steel heavily ported and bored to accommodate the check valves and fluid passages. The complicated internal cavities of such fluid manifold have many stress-concentration sites that can develop fractures over a relatively short time, as a result of fluid pressure pulsations. Improved manifold design is a first step toward achieving increased operating pressures for crankshaft pumps.

Another shortcoming of conventional crankshaft pumps is the lack of operational flexibility, such as output pressure and flow control. External pressure-regulating and pressure-relief valves are required to provide some flexibility. Conventional valves suitable for very high fluid pressures are rare.

Hydraulically operated pressure intensifiers are well-suited for very high pressure applications, due in part to their smooth force transfer and good lubrication. They are the only pumps capable of reliably delivering fluids at pressures greater than about 40,000 psi. Unfortunately, conventional pressure intensifier systems are also more costly because of an extra hydraulic power unit. For example, a complete pressure intensifier system for waterjet applications will have a prime mover such as an electric motor or an engine, a hydraulic pump, a hydraulic reservoir or tank, a water-oil or air-oil heat exchanger or both, an oil filter, a 4-way solenoid-operated hydraulic valve, a double-acting intensifier equipped with power piston position sensors and circuit, an outlet pressure pulsation attenuator, a water inlet charge pump, water filters, support structure, tubing and hoses, and gauges and controls. A schematic diagram of a typical conventional fluid pressure intensifier system is shown in FIG. 3. One of such pressure intensifier systems is taught by U.S. Pat. No. 5,092,744.

The intensification ratio of intensifiers can be as low as about 2:1 or as high as about 20:1. For example, a conventional hydraulic pump capable of producing a 5,000 psi output pressure is commonly used in hydraulic power systems. Many of these pumps have advanced features, such as pressure compensation and output flow adjustment. When such a hydraulic power unit is used to power a pressure intensifier having a 20:1 intensification ratio, for example, an output system pressure of about 100,000 psi can be reliably produced. At present, system pressures considerably greater than about 100,000 psi are produced in such manner for several important yet uncommon applications.

Conventional pressure intensifiers operate relatively slowly; a reciprocating rate of 60 rpm is common. Relatively large intensifiers can be considerably slower because of larger and longer pistons. The relatively slow speed of conventional intensifiers is helpful from a metal-fatigue point of view. Because a double-acting intensifier has only two pistons, its output power continuity is very poor and pressure pulsations are very severe. Therefore, external pressure pulsation attenuators in the form of a dead-volume high-pressure accumulator are practically mandatory for use with pressure intensifiers. This situation also encourages the use of two or more double-acting intensifiers to form a network in order to dampen the output pressure fluctuations.

Multiple intensifiers can be phased together to produce a prescribed "firing order" by controlling the hydraulic fluid flowing in and out of the multiple intensifiers. The aim is to produce as even as possible a power output from the reciprocating motion of all the pistons involved. Electrical drives, mechanical drives or a combination of both are conventionally used to yield such phased operations, but with only partial success. Multiple intensifiers can significantly increase the cost of the system equipment. The high cost of pressure intensifier system equipment is a cause for the current limited growth of waterjet technology.

Another shortcoming of conventional pressure intensifiers is their inflexible power capability. Once constructed, a pressure intensifier has a fixed maximum power output. If greater power output is desired, a physically larger pressure intensifier must be constructed, or another intensifier of the same type must be added to the system. Relatively large intensifiers have larger and longer pistons and therefore must operate at a slower speed, thus resulting in a longer dead moment during the reciprocating movement and aggravating the pressure pulsation problem.

A pressure intensifier of moderate power output is quite bulky and heavy. For example, a conventional 50 hp pressure intensifier may have a 5 inch diameter power piston and can be 40 inches long. A conventional double-acting 50 hp pressure intensifier may have two massive stainless steel end blocks, such as with 8 inches by 8 inches by 4 inches dimensions, and two pressure cylinders, such as with 4 inches by 10 inches dimensions. The amount of expensive materials involved in each pressure intensifier is quite substantial and yet a 50 hp power output is quite modest for waterjetting applications. When one major component of a conventional pressure intensifier fails, such as a cylinder, it is simply discarded.

In view of the current status of high-pressure pumps available for waterjet and other applications, there is quite a demand for significant improvement in the pump design, so that the performance can be improved and the cost reduced. This invention is aimed at accomplishing at least these two basic objectives.

OBJECTS OF THE INVENTION

One overall object of this invention is to provide fluid pressure intensifiers and systems that are significantly superior to existing units and systems.

One specific object of this invention is to provide a multiple-port flow control valve that allows fluids to be routed to four or more different ports continuously and steadily at a prescribed rate and that also routes the spent working fluid back to the fluid reservoir.

Another specific object of this invention is to provide a multiple-cylinder, such as greater than three, fluid pressure intensifier that is capable of continuous power output so that output pressure and flow fluctuations are greatly reduced.

A further object of this invention is to provide a fluid pressure intensifier that has a relatively wide range of power capability so that a single unit can accommodate a wide range of power input without significant changes.

A still further object of this invention is to provide a pressure intensifier that is less expensive to construct and that requires significantly less materials.

A still further object of this invention is to provide a pressure intensifier system that has fewer components, is less expensive to construct, and more versatile to operate than conventional systems.

A yet further object of this invention is to provide a fluid pressure intensifier that can be integrated into systems well suited for remote and difficult fluid-jet applications, such as oil and gas well servicing and drilling operations.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

One way to improve the performance of conventional fluid pressure intensifiers is to add more cylinders and pistons and thereby improve the continuity of output power, such as with automotive engines. It is well known that a six-cylinder engine runs smoother than a four-cylinder engine. This invention adapts a multiple-cylinder approach to fluid pressure intensifiers so as to improve the output power, the output pressure and the output flow.

Figure 4:
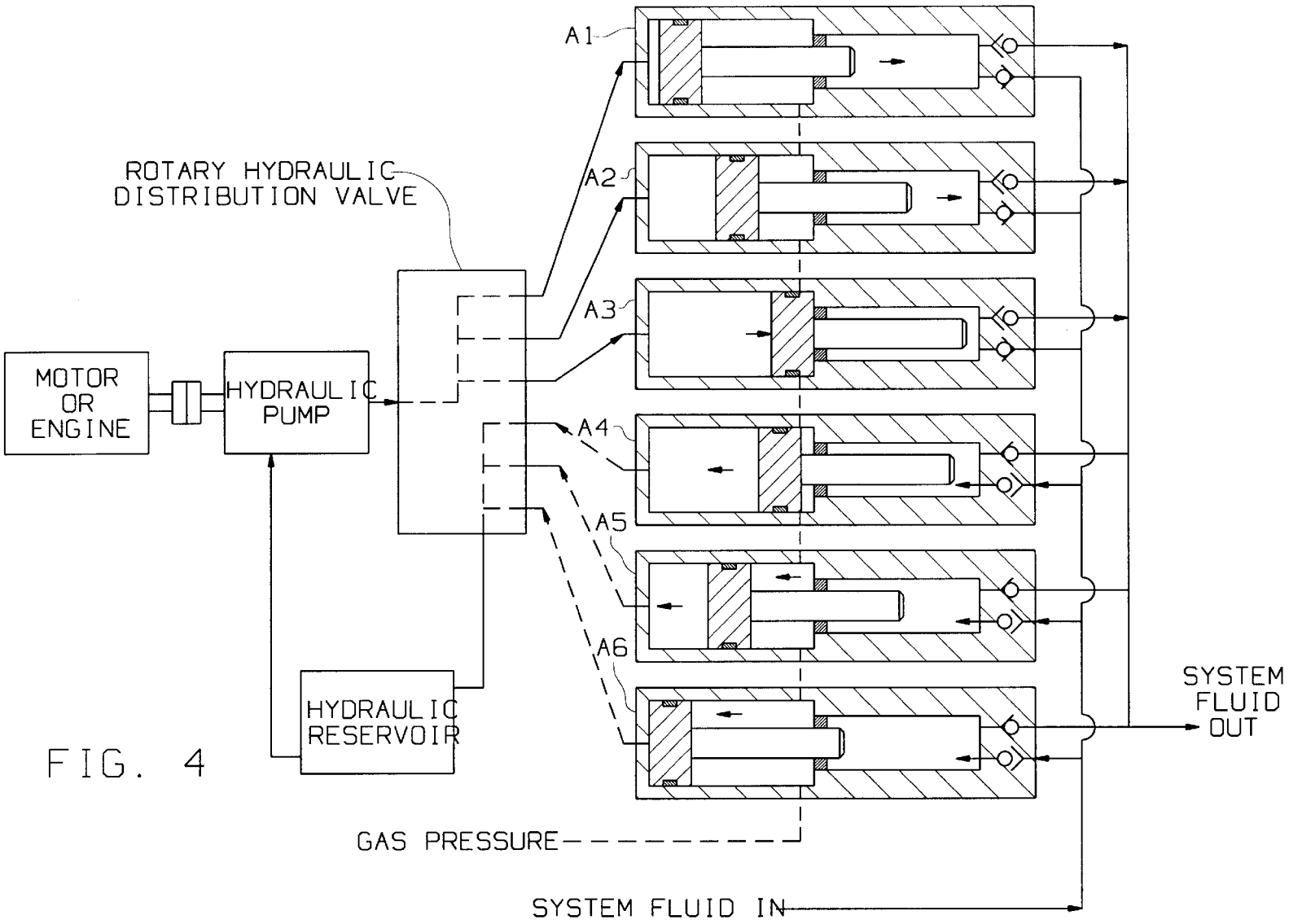
FIG. 4 is a partial cross-sectional diagrammatic view of a pressure intensifier system, according to one preferred embodiment of this invention.

Referring to FIG. 4, one preferred embodiment of this invention comprises six sets of power piston-plunger arrangements A1–A6, similar to those found in conventional single-acting fluid pressure intensifiers. These six pump cylinders all have two sections: a working cylinder that houses the power piston and an adjacent high-pressure cylinder that houses the plunger. The working cylinder is divided by the power piston into two sides: a power chamber having a hydraulic connection to a rotary hydraulic distribution valve and a cocking side connected to a common gas reservoir that serves as a spring to the power pistons. The six high-pressure cylinders all have inlet and outlet check valves that allow the plungers to draw-in and discharge the system fluid.

A conventional hydraulic pump is used to supply the pressurized working fluid that is piped or otherwise transferred to a rotary hydraulic distribution valve according to this invention. The rotary valve of this invention distributes the incoming working fluid to the six cylinders at a prescribed rate dictated by a rotating valve rotor which is driven by an external motor, or by the internal working fluid. At each revolution of the valve rotor, of the six cylinders, three cylinders receive the working fluid while three remaining cylinders communicate with an external drain, which is in communication with the hydraulic reservoir of the working fluid system, and therefore discharge the spent working fluid. Draining spent working fluid is preferably assisted by a gas spring that exerts force on the power pistons. As the rotary valve turns, the six pump cylinders receive the pressurized working fluid, preferably but not necessarily, at a steady rate and in a fixed order. The working fluid exerts force to each power piston, which transfers the force to a corresponding plunger and thus to the system fluid contained in the high-pressure cylinders. When the working fluid enters the working chamber, the system fluid is compressed in the high-pressure cylinder and discharged through the outlet check valve, into the delivery system. This is the so-called power stroke. When the working fluid is discharged from the working chamber, the power piston retracts and the plunger is at its intake or suction stroke, and the system fluid flows into the high-pressure cylinder from an external reservoir. Therefore, the system fluid enters and exits the six intensifiers at the same steady order as the working fluid. At each revolution of the rotary fluid distribution valve, there are two to three power strokes and two to three suction strokes among the six high-pressure cylinders, thus providing steady output pressure.

Figure 5:
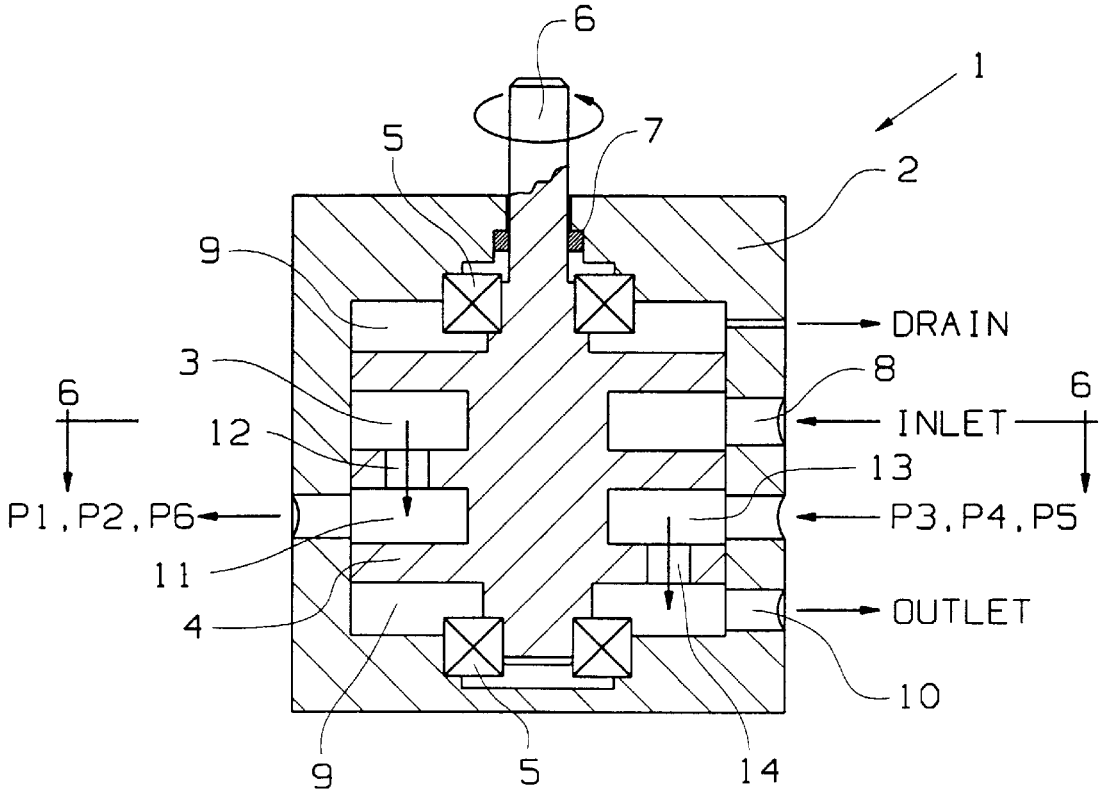
FIG. 5 is a partial cross-sectional view of a valve rotor rotatably mounted within a valve body having six valve ports, according to one preferred embodiment of this invention.
Figure 6:
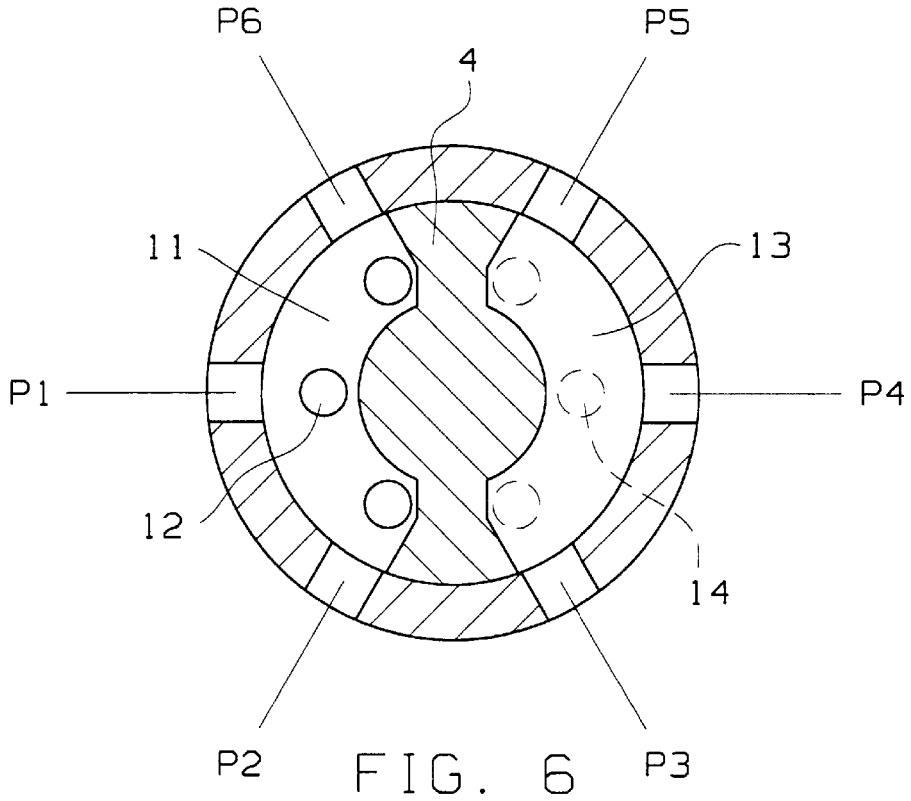
FIG. 6 is a sectional view taken along line 6—6, as shown in FIG. 5.

Referring to FIGS. 5 and 6, one preferred embodiment of this invention comprises rotary fluid distribution to six radially positioned valve ports in a prescribed fashion. The number of valve ports can also be greater or less than six, but there are preferably at least three valve ports. A valve according to one preferred embodiment of this invention comprises valve body 2, with at least one inner wall that preferably has a central cylindrical valve cavity 3 that accommodates valve rotor 4, which is supported by bearings 5 and freely rotates within valve cavity 3, in a snug or tight-fit fashion. Valve rotor 4 comprises rotating shaft 6 which preferably extends out of or beyond valve body 2. Shaft seal 7 keeps fluid from leaking out of valve cavity 3. Valve body 2 has a plurality of valve ports, preferably but not necessarily six valve ports, numbered P1 through P6, as shown in FIG. 6, in communication with valve cavity 3 and system components that receive the fluid from the valve ports P1–P6. In preferred embodiments of the valve assembly according to this invention, isolation means are used to at least partially divide valve cavity 3 into a plurality of voids or chambers. For example, in one preferred embodiment, valve rotor 4 divides valve cavity 3 into three voids or chambers that communicate with each other: an inner power chamber of valve cavity 3, fluid inlet 8, and two outer drain or discharge chambers 9 which are connected to fluid outlet 10. As shown in FIG. 5, valve rotor 4 has circumferential cutout area 11 which is in communication with fluid inlet 8, fluid passage 12 within valve rotor 4 and has oppositely positioned circumferential cutout area 13 which is in communication with fluid outlet 10 and fluid passage 14 within valve rotor 4. Cutout area 11 and cutout area 13 each has a circumferential width or length capable of spanning and thus exposing three adjacent valve ports P1–P6, as shown in FIG. 6. The exact locations of these cutout areas 11, 13 inside valve cavity 3 correspond to the particular design of the six valve ports P1–P6. As valve rotor 4 rotates and pressurized fluid enters valve cavity 3, the fluid enters valve ports P1–P6 that are exposed to the corresponding cutout area 11, 13. At the same time, spent fluid returning to valve 1 will enter cutout area 13 and eventually exit valve 1 and return to the hydraulic reservoir. As shown in FIGS. 5 and 6, the drawings depict valve ports P1, P2 and P6 as receiving pressurized fluid and valve ports P3, P4 and P5 as discharging spent fluid to a system drain, such as through cutout area 13 and fluid outlet 10. As valve rotor 4 rotates, the six valve ports P1–P6 open and close each cycle and are alternatively exposed to power and drain operations over a series of cycles. The rotational speed of valve rotor 4 determines the dwell time of each valve port P1–P6. If the rotational speed is adjustable, the dwell time of valve ports P1–P6 is also adjustable.

Valve rotor 4 as shown in FIG. 5 may be constructed in different forms to facilitate the rotating operation and the distribution of the working fluid to the six valve ports P1–P6. For example, the power cutout area 11 and the drain cutout area 13 can be divided into four quadrants to better balance the fluid-induced forces as the high-pressure fluid is now situated at two opposing sides of valve rotor 4. Rotating such 4-quadrant valve rotor 4 will expose the six valve ports P1–P6 alternately to power and drain functions. With this 4-quadrant arrangement, each rotation of valve rotor 4 preferably produces two cycles of power-drain operation for each of valve ports P1–P6.

Figure 7:
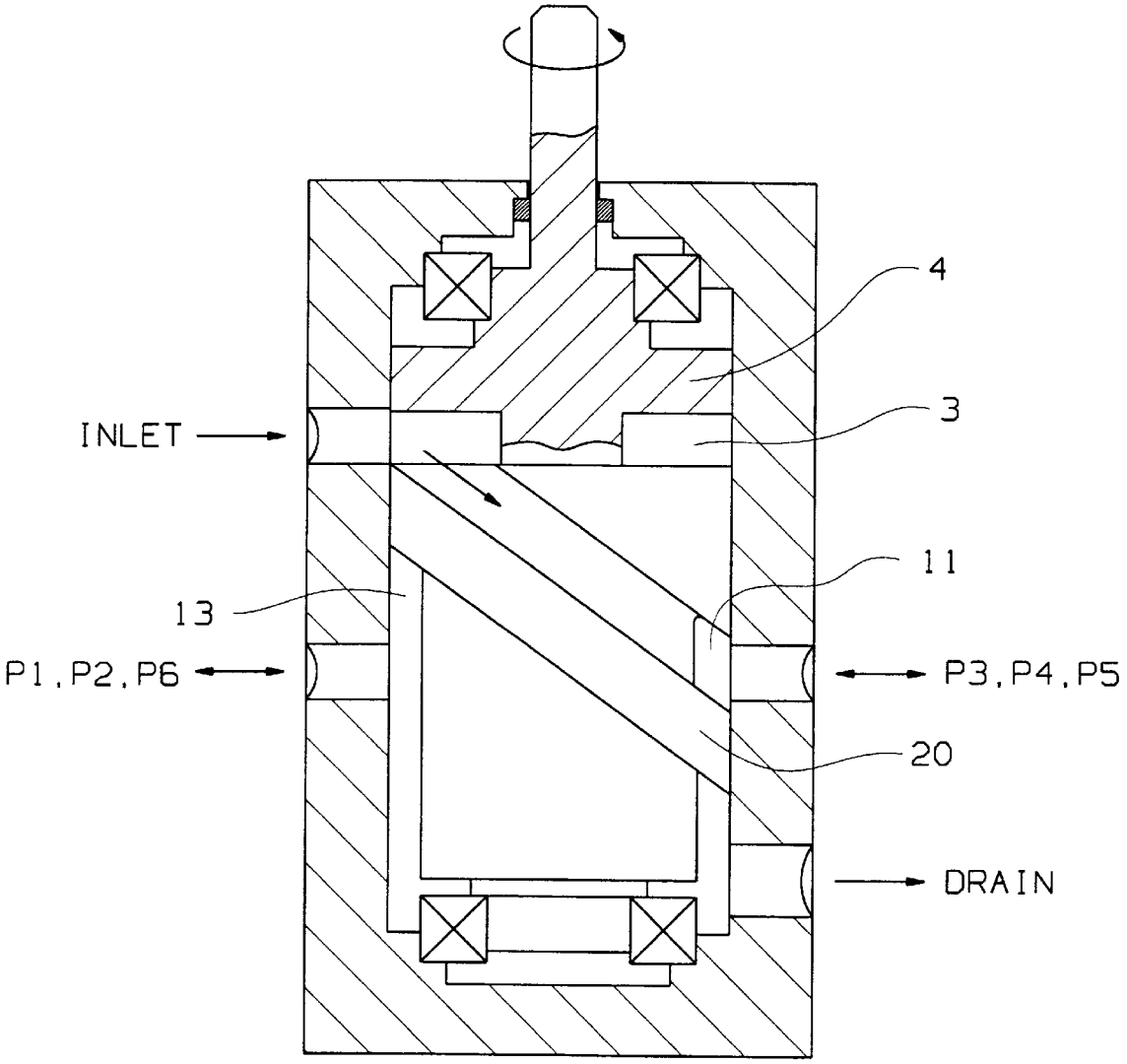
FIG. 7 is a partial cross-sectional view of a valve rotor rotatably mounted within a valve body having six valve ports, according to another preferred embodiment of this invention.

As shown in FIG. 7, the isolation means may comprise cutout area 11 machined as a slanted channel around an outer circumference of valve rotor 4 to balance the fluid-induced forces around valve rotor 4. By having six valve ports P1–P6 situated at a suitable location along valve rotor 4, valve ports P1–P6 will alternately be exposed to the power and drain of working fluid upon rotation of valve rotor 4, as shown in FIG. 6. With this slanted channel arrangement, each rotation of valve rotor 4 will produce one cycle of power-drain operation over the six valve ports P1–P6. It is apparent that slant-cut power channel 11 and adjacent drain area 13 and ridge 20 therebetween, as shown in FIG. 7, must be sized and spaced correctly with respect to valve ports P1–P6, or any other suitable number of valve ports, to ensure proper operation. Ridge 20 which is preferably positioned between and separates power channel 11 and drain area 13 momentarily blocks at least one of valve ports P1–P6 as valve rotor 4 rotates.

Power cutout area 11 and drain cutout area 13 can also be formed or machined as helical or spiral channels positioned about valve rotor 4, about a full circumference in order to balance the fluid-induced forces about valve rotor 4. By situating six valve ports P1–P6 at a suitable location with respect to valve rotor 4, valve ports P1–P6 will have alternate exposure to the power-drain modes of operation of the working fluid, upon rotation of valve rotor 4, similar to the embodiment as shown in FIG. 7. Such helical or spiral-cut arrangement produces one cycle of power-drain operation for each rotation of valve rotor 4, for example at the six valve ports P1–P6. It is apparent that spiral-cut power and drain grooves should be sized and spaced as a function of the design of valve ports to ensure proper operation.

Figure 8:
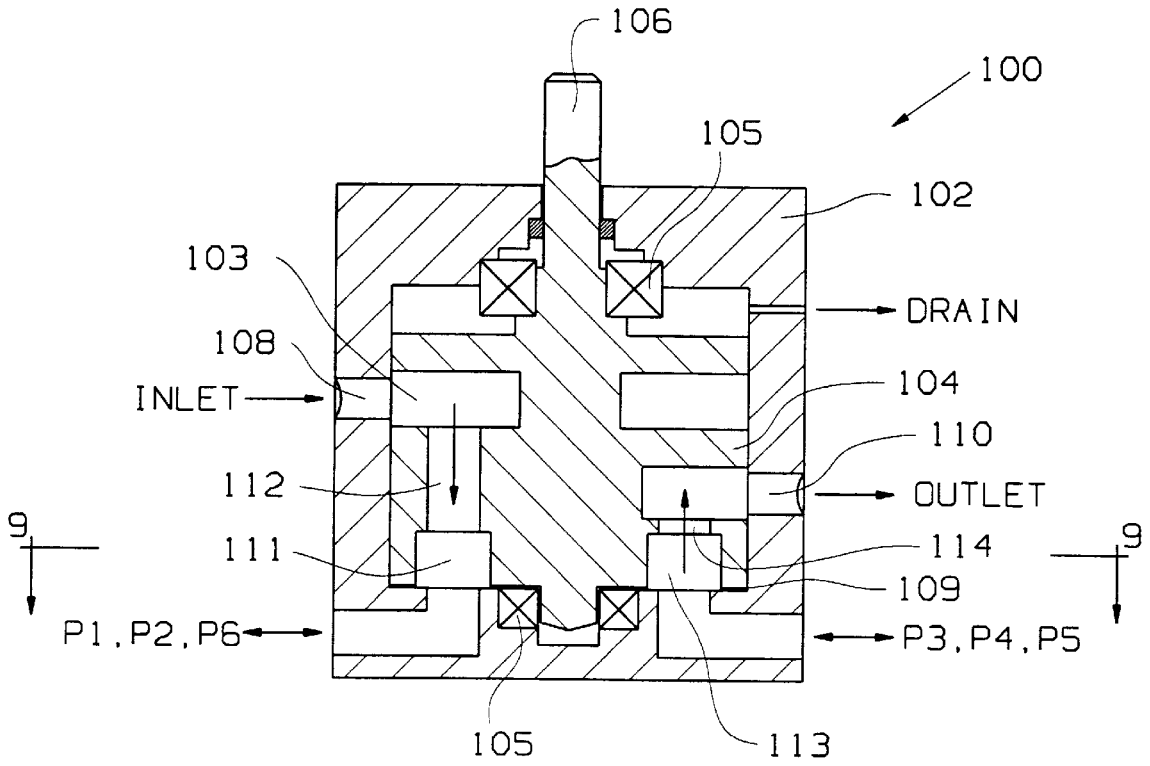
FIG. 8 is a partial cross-sectional view of a valve rotor rotatably mounted within a valve body having six valve ports, according to another preferred embodiment of this invention.
Figure 9:
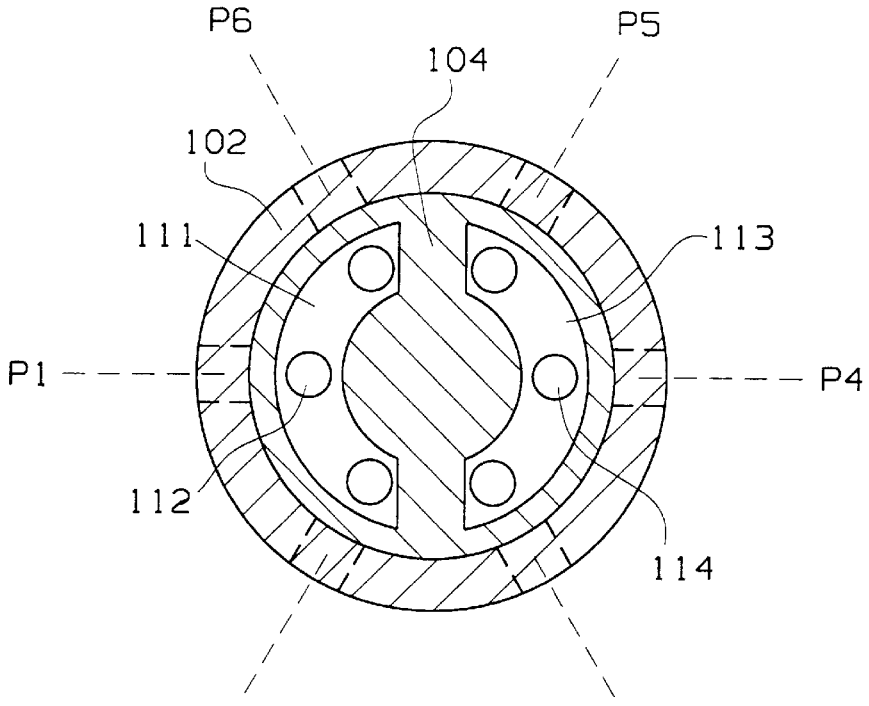
FIG. 9 is a sectional view taken along line 9—9, as shown in FIG. 8.

The rotary fluid distribution valve can be constructed according to different embodiments of this invention. For example, FIGS. 8 and 9 illustrate another preferred embodiment of rotary fluid distribution valve 100, according to this invention. Valve 100 is designed to handle six valve ports P1–P6, although the number of valve ports can be more or less than six; for example, four to nine valve ports would provide a smooth-operating, low-shock valve assembly. Valve 100 as shown in FIGS. 8 and 9 comprises valve body 102 which has central valve cavity 103 that accommodates valve rotor 104. Bearings 105 preferably support valve rotor 104 in a manner that allows valve rotor 104 to freely rotate within valve cavity 103. Valve rotor 104 further comprises rotating shaft 106 which extends outward with respect to valve body 102, for transmitting torque to and/or for monitoring the rotational speed of valve rotor 104. Shaft seal 107 prevents fluid from leaking out of valve cavity 103.

In one preferred embodiment according to this invention, valve body 102 has six valve ports P1–P6 positioned on a relatively flat face 109 of valve body 102 which defines valve cavity 103. In such preferred embodiment, the six valve ports P1–P6 arc preferably equally spaced at 60° intervals. Valve ports P1–P6 connect valve cavity 103 to six external system components that receive the system fluid. In such preferred embodiment, the isolation means comprise valve rotor 104 dividing valve cavity 103 into two portions: an upper power chamber, shown in FIG. 8 as element reference number 103, which is in communication with fluid inlet 108 and passage 112; and a lower drain chamber, shown in FIG. 8 between fluid outlet 110 and passage 114, which is in communication with fluid outlet 110 and passage 114.

As shown in FIG. 8, valve rotor 104 comprises a flat bottom face in contact with flat face 109 of valve body 102, which reduces the drain chamber to an interface of valve rotor 104 and valve cavity 103. Valve rotor 104 preferably has a bottom machined cutout area 111 in communication with fluid inlet 108 and passage 112, and an oppositely positioned machined cutout area 113 in communication with fluid outlet 110 and passage 114. Cutout areas 111 and 113 can be kidney-shaped and can have an area which is large enough to cover three adjacent openings of valve ports P1–P6 on flat face 109. As valve rotor 104 rotates, cutout area 113 communicates with two or three adjacent valve ports P1–P6 while cutout area 114 communicates with the opposite two or three adjacent valve ports P1–P6. As valve rotor 4 rotates, for a relatively brief time period, two diametrically opposite valve ports P1–P6 are completely blocked by valve rotor 104. Such brief time period relates to a transition point through which the system fluid changes direction of flow. It is apparent that flat face 109 should be in intimate contact with the matching flat face of valve rotor 104, in order to minimize fluid leakage and yet maintain free rotation of valve rotor 104. The rotational speed of valve rotor 104 determines an amount of system fluid which flows through valve ports P1–P6 within each cycle of direction change.

Figure 10:
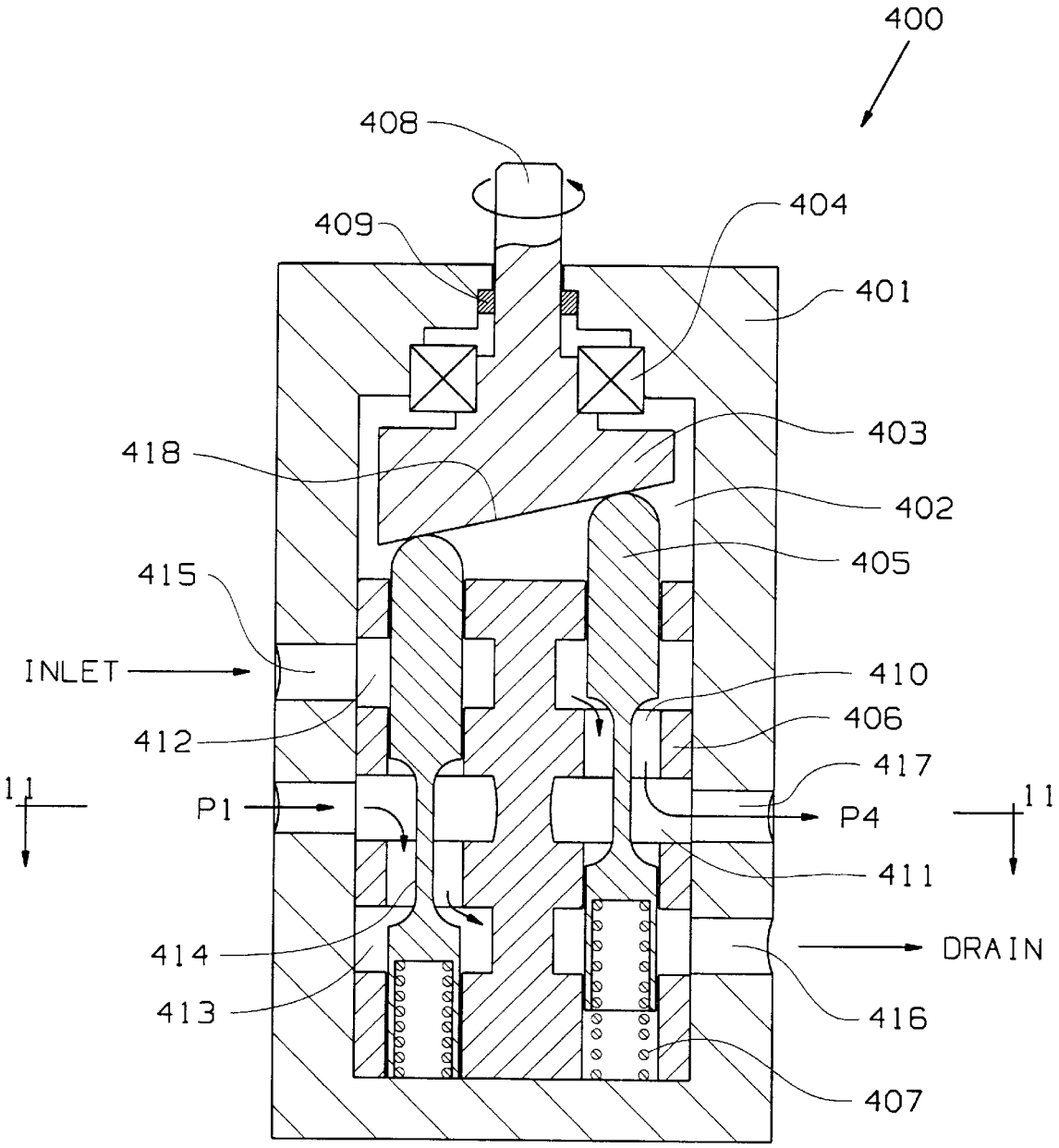
FIG. 10 is a partial cross-sectional view of a valve rotor and six valve rods mounted within a valve body, according to another preferred embodiment of this invention.
Figure 11:
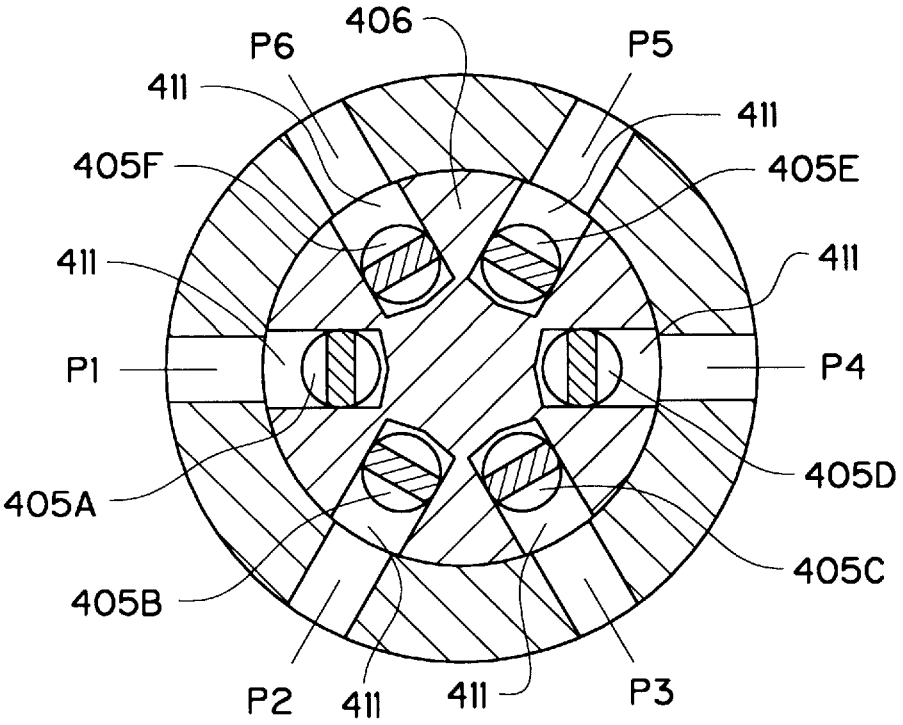
FIG. 11 is a sectional view taken along line 11—11, as shown in FIG. 10, with the valve rods removed.

According to another preferred embodiment of this invention, as shown in FIGS. 10 and 11, rotary valve 400 operates on a principle of translating rotational motion of valve rotor 403 to reciprocating motion of multiple valve rods 405 that are used to alternately open and close valve ports P1–P6. Rotary valve 400 comprises valve body 401, cylindrical central valve cavity 402, housing valve rotor 403 which is supported by bearings 404, multiple valve rods 405, valve rod cage 406, multiple rod springs 407, valve rotor shaft 408 and shaft seal 409.

In such preferred embodiment, the isolation means comprise valve rod cage 406 positioned within valve cavity 402 in a snug or tight-fitting manner and having six radially positioned, axially parallel holes 410 which accommodate six valve rods 405 at approximately equally spaced 60° intervals. Valve rod cage 406 has six side ports 411 positioned at approximately equally spaced 60° radially intervals, in order to communicate with holes 410. Valve rod cage 406 also has two radially cutout areas 412 and 413 that act as common fluid passages which communicate with the six valve rod holes 410.

The multiple valve rods 405 are preferably but not necessarily identical, with one round end and one flat end. As shown in FIG. 10, the flat end of each valve rod 405 has a cavity for accommodating a compression spring 407 that provides a relatively constant bias force. Valve rods 405 each have a cutout area 414 of a determined length, location and thus volume in order to act as a fluid passage. Valve rods 405 fit in a snug or tight-fitting manner within valve rod holes 410 but yet valve rods 405 are free to slide in an upward and downward direction, as shown in FIG. 10. Rod seals can be used to prevent fluid leakage about valve rods 405, when preferred.

Still referring to FIGS. 10 and 11 valve body 401 comprises fluid inlet 415, fluid outlet 416, and six radially positioned valve ports 417 each in communication with external system components that receive the working fluid which flows through rotary valve 400. Various ports of valve body 401 are preferably positioned according to prescribed positions as shown in FIG. 10 so that when valve rod cage 406 is fitted within valve cavity 402, inlet 415 is aligned with cavity 412, outlet 416 is aligned with cavity 413, and the six valve ports 417 are aligned with the six side ports 411 of valve rod cage 406. Locking means can be used, if desired, to lock valve rod cage 406 within valve cavity 402.

As shown in FIGS. 10 and 11, valve rotor 403 comprises slanted face 418 which engages the round end of each of the six valve rods 405 when rotary valve 400 is fully assembled. Valve rod springs 407 push corresponding valve rods 405 against slanted face 418, preferably at all times. The particular angle of slanted face 418 is determined by a desired travel of valve rod 405. Both valve rotor 403 and valve rods 405 are preferably constructed of hardened steel. The round end of each valve rod 405 can be a separate sphere or ball, such as a ball bearing, or a roller of appropriate size, any of which may minimize wear and friction. As valve rotor 403 is rotated, for example by applying torque to valve rotor shaft 408, slanted rotor face 418 forces valve rods 405 downward, as shown in FIG. 10, to produce oscillating motion on valve rods 405. Such oscillating motion alternately forms communication with the six valve ports P1–P6 and valve inlet 415 or valve outlet 417. As shown in FIG. 11, valve rod 405 on the left side represents a lowest position that valve rod 405 can attain while valve rod 405 on the right side is at its highest position. The other four valve rods 405 that are not shown in FIG. 10 are at positions between such lowest position and such highest position.

Regarding valve rod 405A as shown in FIG. 11, if cutout area 414 is positioned to communicate with valve port P1 and cutout area 413, spent working fluid is passed from valve port P1 to drain. With valve rod 405D, cutout area 414 is positioned to communicate with valve port P4 to cutout area 412, to send high-pressure working fluid to valve port P4 and to system components receiving the working fluid. Valve rods 405B and 405F, as shown in FIGS. 10 and 11, are at partially open positions with respect to valve outlet 416 while valve rods 405C and 405E are at partially open positions with respect to valve inlet 415.

During each rotation of valve rotor 403, as shown in FIG. 10, each valve rod 405 completes one cycle of valve port operation which communicates the six valve ports P1–P6 from power to drain modes. Thus, as valve rotor 403 rotates at a constant rotational speed, as shown in FIG. 10, valve rods 405 oscillate at a similar frequency thereby sending the high-pressure working fluid from a single source to six separate components. Thus the spent working fluid is received from the six external system components and the spent working fluid is routed back to the reservoir of the working fluid system.

Due to the fact that the ends of valve rods 405, which are not exposed to the high-pressure fluid, and each fluid passage 414 is of simple geometry, valve rods 405 are not subjected to significant forces resulting from the working fluid. Thus, valve rods 405 are relatively easy to move. As valve rotor 403 rotates, valve rotor 403 does not require powerful torque but rather the rotation can be accomplished with a relatively small electrical, hydraulic or air-powered motor. One relatively convenient way to rotate valve rotor 403 is to use the available high-pressure fluid to generate the torque through an internal hydraulic motor.

Still referring to FIGS. 10 and 11, rotary valve 400 has one disadvantage of having more parts than the number of parts shown in previously discussed preferred embodiments of this invention. However, such disadvantage may be outweighed by the advantage of reduced friction and wear, as well as the ease of fabrication, because a single valve rotor requires a relatively high level of precision machining and fitting. With multiple valve rods 405, the fabrication of valve parts is significantly easier. To facilitate valve operation, valve rod springs 407 can be eliminated and replaced with another suitable dampening device, such as compressed air or compressed gas which could be routed into valve cavity 402, for example, from an external storage chamber. With such gas springs, the bias force can be more uniform and have a faster response. Valve 400 of this invention can be more reliable by constructing valve rod cage 406, valve rods 405 and valve rotor 403 with suitable materials, such as hardened steel, and by sizing such parts with a relatively high degree of precision.

Referring back to FIG. 4, a rotary valve according to one preferred embodiment of this invention is used to operate six single-acting fluid pressure intensifiers in a very orderly fashion, in order to maintain a steady output pressure without the need for complex electronic control systems that are currently used to link multiple conventional intensifiers to dampen pressure fluctuations. The rotary valve according to this invention can serve as few as two intensifiers or as many as more than six intensifiers. In a six intensifier system, as shown in FIG. 4, about 2 to 3 intensifiers will be in each power stroke at any given time, thereby providing steady output pressure. Referring back to FIGS. 5–9, rotary valve 1 according to this invention can be different from rotary valve 1 shown in the drawings. For example, rotary valve 401 of this invention can have multiple valve ports, preferably three or more, positioned in multiple rows or at irregular angular spacing. Two or more rotary valves 1 of this invention can be ganged together according to a prescribed movement pattern, to provide a complicated valving operation without electronics. Such mechanically-operated valves can be very reliable and simple to construct and operate.

Figure 12:
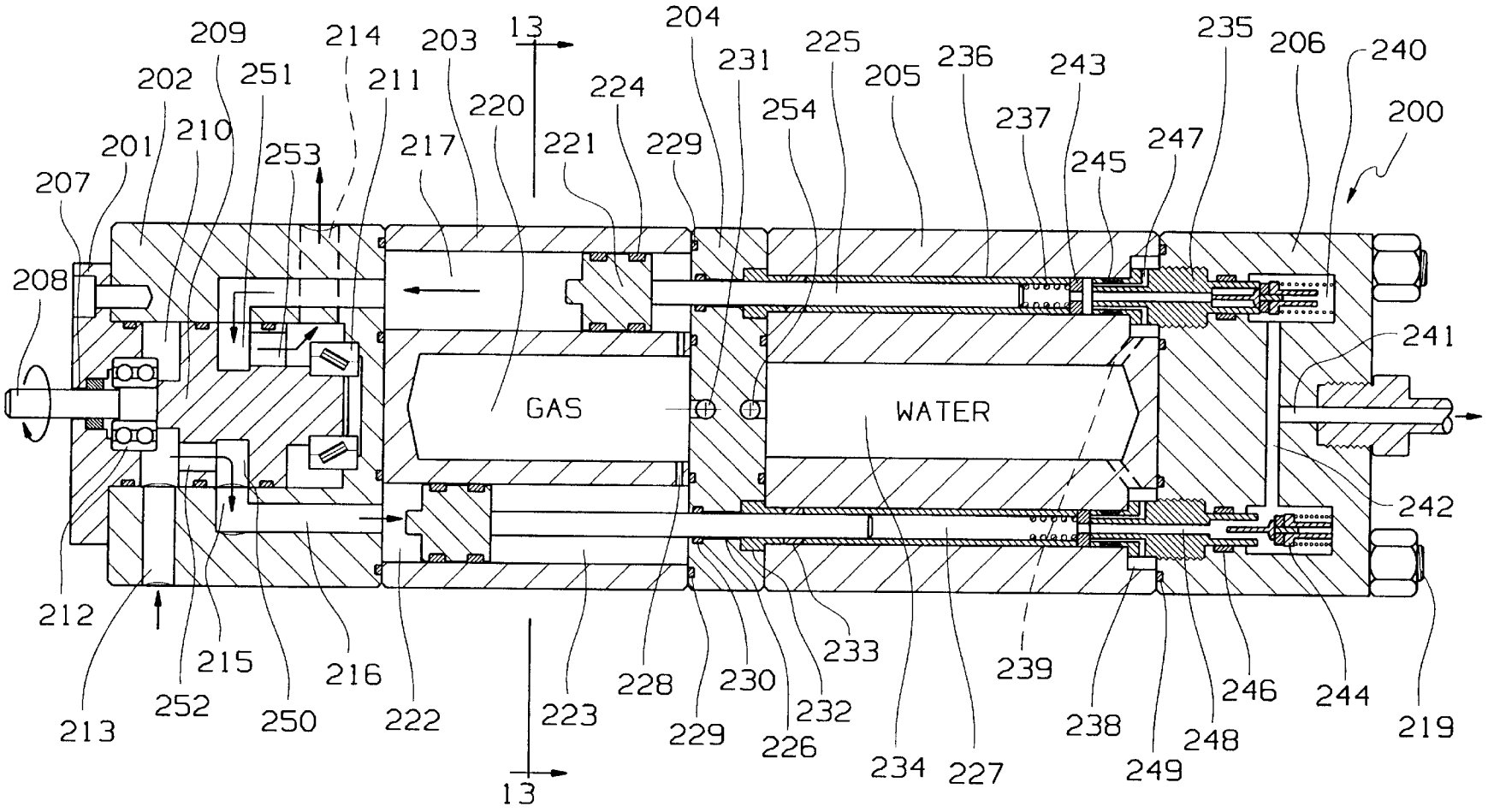
FIG. 12 is a partial cross-sectional view of a six-cylinder rotary fluid pressure intensifier assembly, according to one preferred embodiment of this invention.

For relatively high-pressure fluid pressure intensification operations, it is relatively costly to use multiple intensifiers, as shown in FIG. 4. It is advantageous to combine the multiple intensifiers into a single unit. In another preferred embodiment of this invention, a fluid pressure intensifier has the performance capabilities of multiple intensifiers, without the relatively high cost and complicated control systems associated with conventional systems. In one preferred embodiment of this invention, multiple, single or double acting intensifiers are combined and a rotary fluid distribution valve, as shown in FIG. 4, is used to form a single cylindrical intensifier unit. FIG. 12 shows a six cylinder rotary intensifier 200 which comprises six major sections which are bolted together. As shown in FIG. 12 from left to right, such sections include end cover 201, valve cylinder 202, power cylinder 203, mating disk 204, high-pressure cylinder 205 and outlet cylinder 206. Such six sections are preferably bolted together to form a single cylindrical unit of prescribed diameter and length, which is designed to handle a prescribed power.

Figure 13:
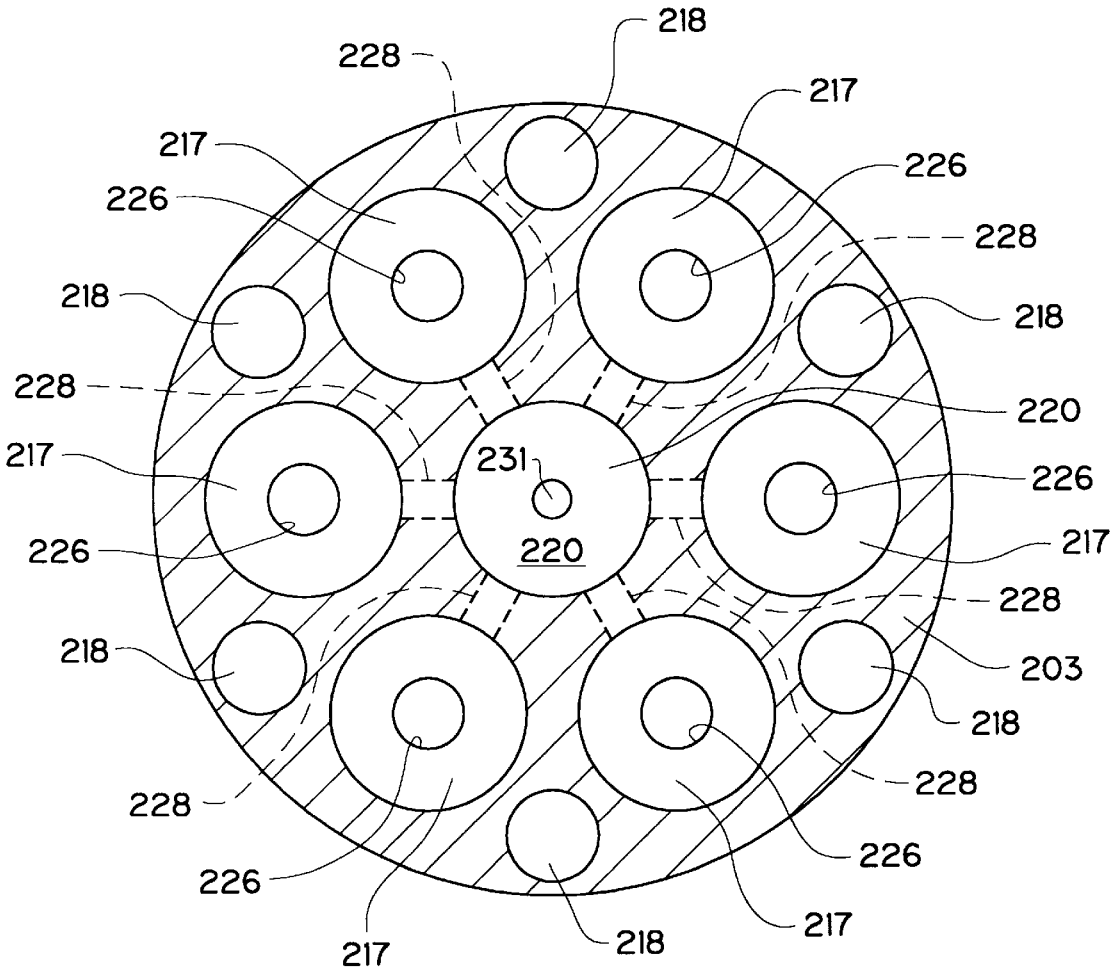
FIG. 13 is a sectional view taken along line 13—13, as shown in FIG. 12 but with the power pistons and connected plungers not shown for clarity reasons.

As shown in FIG. 12, end cover 201 preferably has central hole 207 to engage center shaft 208 of valve rotor 209, which is positioned within central valve cavity 210 of valve cylinder 201. Valve rotor 209 is preferably supported by thrust bearing 211 and radially bearing 212. Seals around valve rotor 209 and end cover 201 provide fluid-tight sealing at strategic locations. Valve cylinder 202 has fluid inlet 213 in communication with one side of valve rotor 209 and has fluid outlet 214 in communication with the other side of valve rotor 209. Valve cylinder 202 has six radial ports 215 spaced at approximately 60° intervals about a circumference of central valve cavity 210. Radial ports 215 follow an approximate 90° turn and in a downstream direction become six axially ports 216 that are parallel with respect to each other and that are mated with six power chambers 217 of power cylinder 203. FIG. 13 is a sectional view taken along line 13—13 as shown in FIG. 12 but with power pistons 221 and plungers 225 removed for clarity reasons. As shown in FIG. 13, power cylinder 203 of a rotary intensifier according to this invention has six chambers 217 of prescribed diameter and location which are spaced at approximately 60° radial intervals. Six parallel holes 218 accommodate tie bolts 219. Center cylindrical chamber 220 may act as a housing for air or nitrogen that can provide a spring or bias force to power pistons 221.

Referring back to FIG. 12, power cylinder 203 accommodates six power pistons 221 that are slidably mounted within chambers 217. Power piston 221 divides chamber 217 into power chamber 222 on one side and cocking chamber 223 on the other side. Power pistons 221 each has radial piston seal 224 which prevents fluid from leaking. Power pistons 221 have connected plungers 225 of prescribed diameters and lengths on the other side. Plungers 225 extend through passages 226 of mating disk 204 and into high-pressure chambers 227 of high-pressure cylinder 205.

Power cylinder 203 has multiple gas passages 228 which allow cocking chambers 223 to communicate with gas reservoir 220. Multiple static seals 229 and dynamic seals 230 provide gas-tight sealing to prevent leakage. Mating disk 204 has fluid ports 231 and 254 to gain access to its two faces, and has plunger bushings 232 for supporting plungers 225 and the corresponding dynamic seals 233.

High-pressure cylinder 205 has central cylindrical chamber 234 for storing water, or other system fluids, which communicates with port 254, an inlet for the system fluid.

The six high-pressure chambers 227 of high-pressure cylinder 205, in the embodiment of this invention shown in FIG. 12, engage plunger bushings 232 on one side and check valve bodies 235 on the other side to form fluid-tight cavities. The six high-pressure chambers 227 have cylindrical spacers 236 that act as support to inlet check valve springs 237.

Check valve bodies 235 are positioned in a central area of inlet cavities 238 which are in communication with system fluid reservoir 234, such as through multiple passages 239. Check valve bodies 235 are preferably threaded into outlet cavities 240 of outlet cylinder 206. Outlet cavities 240 are in communication with central fluid outlet 241, such as through multiple passages 242. Check valve bodies 235 preferably have inlet check valves 243 on a plunger side and outlet check valves 244 on the other side.

Static seals 245 and 246 provide high-pressure sealing. Check valve bodies 235 have parallel multiple fluid inlets 247 that communicate with inlet cavities 238 and high-pressure chambers 227, and central fluid outlet 248 that communicates with high-pressure chambers 227 and outlet check valves 244, as well as outlet cavities 240. Static seals 249 provide fluid-tight sealing between adjacent high-pressure cylinder 205 and outlet cylinder 206. Inlet check valves 243 can be of a conventional disk type that function by sealing an inlet face of check valve body 235, or can be any other suitable check valve of another design known to those skilled in the art. Outlet check valves 243 can be of a similar conventional disk type, or can be of a type such as taught by U.S. Pat. No. 5,241,986, similar to that as shown in FIG. 7. Regardless of the type of check valve, the inlet and outlet check valves according to this invention should be reliable at relatively high fluid pressures and at relatively high cycling rates.

Still referring to FIG. 12, valve rotor 209 has a design similar to that as shown in FIGS. 5 and 6. Valve rotor 209 has power cutout area 250 sized in width to cover three fluid ports 215 and has drain cutout area 251 of a width similar to that of power cutout area 250 allows communication between fluid inlet 213 and passage 252 while drain cutout area 251 allows communication between fluid outlet 214 and passage 253.

Still referring to FIG. 12, when pressurized working fluid enters fluid inlet 213 and a torque is applied to valve shaft 208, such as with a relatively small electric or hydraulic motor, the working fluid is distributed to the six power cylinders 217, to exert force upon power pistons 221 at a prescribed rate. At the same time, the system fluid, such as water in waterjetting applications, enters reservoir 234 through port 254 and ultimately into high-pressure chambers 227, through passages 239, inlet cavities 238, check valve passages 247 and inlet check valves 243. The flow of working fluid and the rotation of valve rotor 209 causes the six power pistons 221 to slide back and forth in a prescribed order and speed. Connected plungers 225 also slide back and forth within the high-pressure chambers 227. Prescribed forces are transferred from power pistons 221 to plungers 225. Thus, energy of prescribed magnitude transfers from the working fluid to the system fluid. Because of the inlet and outlet check valves according to this invention, the system fluid, such as water, enters the pressure intensifier at a relatively low pressure and discharges at a much higher pressure. The exact pressure intensification ratio is a function of the design parameters of the pressure intensifier.

The rotary intensifier according to this invention functions if a prescribed torque is applied to the valve rotor, so as to produce rotation at a particular rotational speed. An external electric gear motor or an external hydraulic motor equipped with a control valve for setting the rotational speed, for example, can be used to provide the necessary torque. Any such hydraulic motor can be conveniently integrated into the valve cylinder of the pressure intensifier according to this invention.

Figure 14:
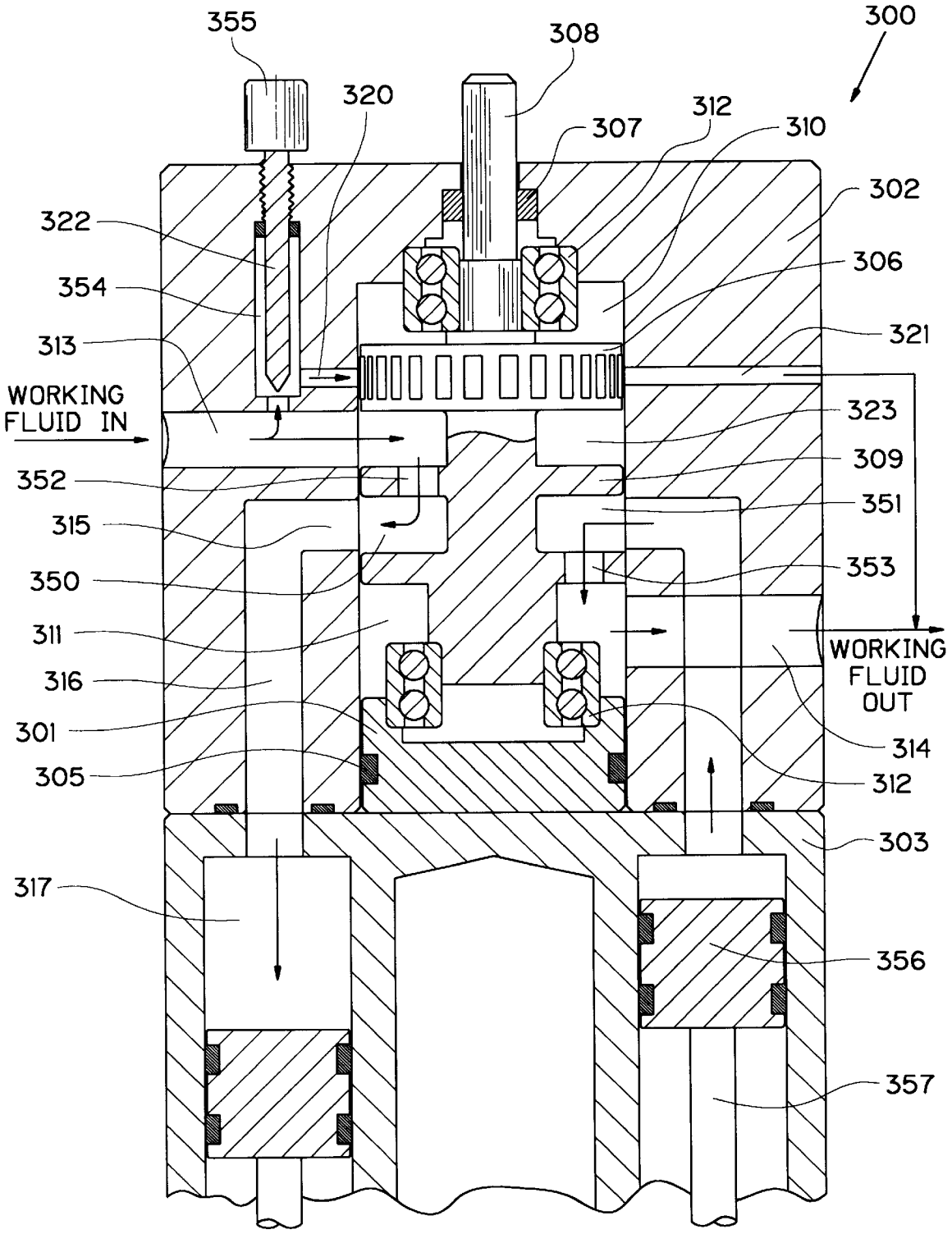
FIG. 14 is a partial cross-sectional view of a valve rotor with an integrated upper motor section rotatably mounted within a valve cavity of a valve body, according to another preferred embodiment of this invention.

Referring to FIG. 14, in another preferred embodiment according to this invention, a six cylinder fluid pressure intensifier has a built-in hydraulic motor for generating the torque necessary to rotate valve rotor 309. Valve rotor 309 and the motor rotor are integrated together to form a single unit. FIG. 14 shows the valve-cylinder portion of the pressure intensifier according to this preferred embodiment.

Pressure intensifier 300 comprises valve cylinder 302 at one end, bolted together with power cylinder 303, and other components as shown in FIG. 12 and described above, which are not shown in FIG. 14. Valve cylinder 302 comprises central cylindrical cavity 310 which houses valve rotor 309, preferably in a snug or tight-fitting manner, which is supported at ends by bearings 312. Valve rotor 309 is free to rotate within central cylindrical cavity 310. Valve rotor 309 comprises end shaft 308 which extends outside and has a shaft seal 307 to prevent fluid leakage. At the opposite end, valve rotor 309 has bearing support 301 with seal 305 to prevent fluid leakage. Valve cylinder 302 has fluid inlet 313 and fluid outlet 314 which is in communication with central cylindrical cavity 310. Valve rotor 309 has an upper motor section 306, preferably but not necessarily with circumferentially arranged cutout indents of a particular width and depth, for accommodating pressurized working fluid in order to generate torque. It is apparent that other fluidic motor components can be used to accomplish the same result of rotating valve rotor 309.

Rotor section or disk 306 is similar to a gear-teeth setup or a turbine wheel of a water turbo electric generator, and is in communication with fluid passage 320 that is also in communication with fluid inlet 313, and that is in communication with fluid passage 321 which is in communication with fluid outlet 314 or, for example, a drain line to the working fluid reservoir.

Fluid passages 320 and 321 are preferably arranged in a tangential relationship with respect to upper motor section 306 of valve rotor 309, such that pressurized fluid flows into passage 320 which will transfer stored energy to upper motor section 306 and then will exit or discharge through passage 321, much like the action within a turbogenerator. Fluid passage 320 is preferably operated by needle valve 322, which allows the flow rate of the pressurized fluid entering passage 320 to be increased or decreased and thereby adjust the rotational speed of valve rotor 309. In one preferred embodiment according to this invention, an external tachometer can be used in connection with motor shaft 308, to monitor the rotational speed of valve rotor 309.

Valve rotor 309 preferably has an annular cutout area 323 which is positioned to communicate with fluid inlet 313. Valve cylinder 302 also has six radially positioned ports 315 spaced approximately at 60° intervals about a circumference of central cavity 310. Such radial ports 315 follow a 90° turn and become six axial ports 316 that are parallel with respect to each other and that correspondingly communicate with the six power chambers 317 of power cylinder 303. The self-rotating valve rotor 309 as shown in FIG. 14 is similar to the valve rotor shown in FIG. 12, except that valve rotor 309 as shown in FIG. 14 also comprises power cutout area 350 which is in communication with annular cutout area 323 and fluid passage 352. Valve rotor 309 comprises drain cutout area 351 which is in communication with drain cavity 311 of valve cavity 310 and fluid passage 353. Power cutout area 350 and drain cutout area 351 are preferably but not necessarily sized and shaped in a manner which is similar to that as shown in FIGS. 5 and 6.

Still referring to FIG. 14, when pressurized working fluid enters fluid inlet 313 of valve cylinder 302, the majority of fluid flows into annular cutout area 323 which is positioned about valve rotor 309, into fluid passage 352, into power cutout area 350, and into the valve ports that are open to power cutout area 350. In one preferred embodiment of this invention, a relatively small portion of the pressurized working fluid flows into needle valve cavity 354, into fluid passage 320, and impinges against upper motor section 306 of valve rotor 309 and thereby transfers energy to and rotates valve rotor 309. The relatively small portion of spent working fluid discharges through fluid passage 321 and preferably returns to a reservoir of the working fluid system. Needle valve 322 has external adjustment means for moving needle valve 322 into and out of a seated position with respect to valve cylinder 302. In one preferred embodiment according to this invention, the external adjustment means comprise knob 355, as shown in FIG. 14, for rotating needle valve 322 and thereby adjusting the flow rate of the portion of pressurized working fluid that is diverted to transfer energy and thus rotate valve rotor 309.

As valve rotor 309 rotates, a majority of the working fluid flows through the six radial ports 315 of valve cylinder 302, at a predetermined velocity and order into and out of the six power chambers 317 of the power cylinder 303. Within each power chamber 317, the working fluid transfers potential energy to power pistons 356, that then transfer energy to system fluid through connecting plungers 357. Spent working fluid returns to valve cylinder 302 and then is discharged through drain passages of valve rotor 309.

FIG. 14 shows torque-generating means for applying torque to valve rotor 309. Such torque-generating means have one advantage of simplicity due to integration with the structure of valve rotor 309. However, other preferred embodiments of torque-generating means can be used to generate torque internally, such as by using energy from the available working fluid. For example, vanes and gears can be incorporated, such as those used in commercially available vane motors and gear motors, into valve rotor 309 of this invention in order to generate torque. However, use of such conventional mechanisms are relatively complicated and contain many additional moving parts. According to the valve of this invention, in conditions which a fixed and precise rotational velocity of valve rotor 309 is required, more sophisticated torque-generating mechanisms can be used, if necessary. For example, powered servomotors can be used in a self-regulating mode to generate energy that rotates valve rotor 309.

Figure 15:
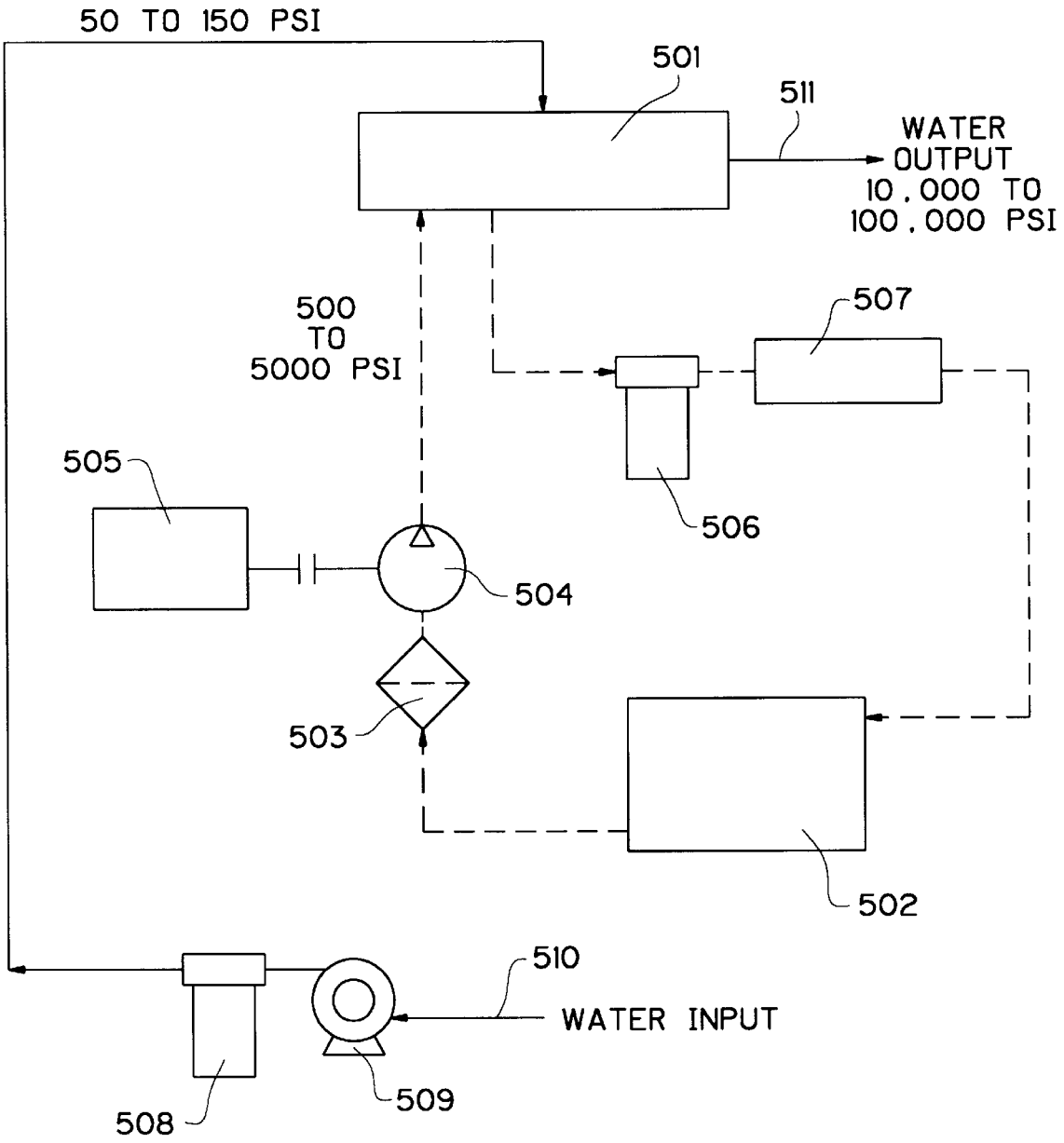
FIG. 15 is schematic diagram of a pressure intensifier system, according to one preferred embodiment of this invention.

Rotary fluid pressure intensifiers according to this invention can be advantageously used to construct fluid power systems for various industrial applications, such as generating high-pressure waterjets for cutting materials. FIG. 15 illustrates a schematic diagram of a waterjet fluid-power system which is configured for water applications. As shown in FIG. 15, a rotary intensifier 501 has an internal integrated hydraulic motor which provides necessary torque and thus rotates the valve rotor at a prescribed rotational speed. Referring back to FIG. 15, hydraulic working fluid is drawn from hydraulic reservoir 502, through strainer 503 and into hydraulic pump 504, which is powered by engine or electric motor 505, to raise the working fluid to a pressure in a range from about 500 to about 5,000 psi. The pressurized working fluid is then piped or otherwise transferred to rotary intensifier 501, according to this invention, at a prescribed flow rate which is dictated by a design of rotary intensifier 501 and/or hydraulic pump 504.

Once the pressurized fluid enters rotary intensifier 501, in one preferred embodiment according to this invention, the pressurized fluid rotates the valve rotor and generates reciprocating motion to power pistons and plungers. Simultaneously, water from a external source, such as water input 510, is transferred to charge pump 509 which increases the water pressure to a level generally ranging from about 50 psi to about 150 psi. The water then flows through filter 508 or another suitable filtration system, to remove impurities. The water then flows into rotary intensifier 501, according to this invention, such as through inlet check valves. Inside the high-pressure chambers of rotary intensifier 501, energy is transferred to the water for moving the plungers and then exits through the outlet check valves at a relatively higher pressure, such as about 10,000 psi to about 100,000 psi. This high-pressure water is then piped or otherwise transferred to nozzles for generating high-speed waterjets.

Figure 1:
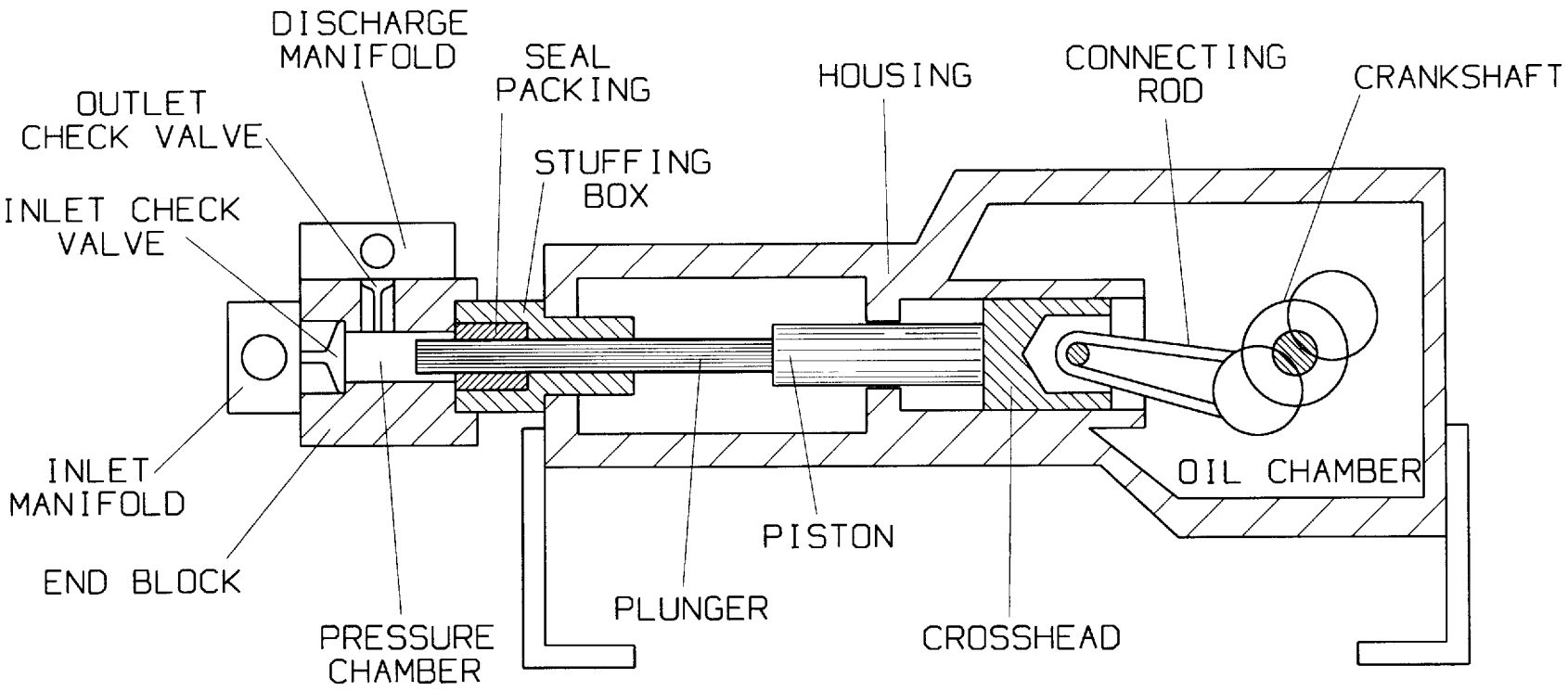
FIG. 1 (PRIOR ART)
FIG. 1 is a partial cross-sectional view of a conventional crankshaft pump.
Figure 2:
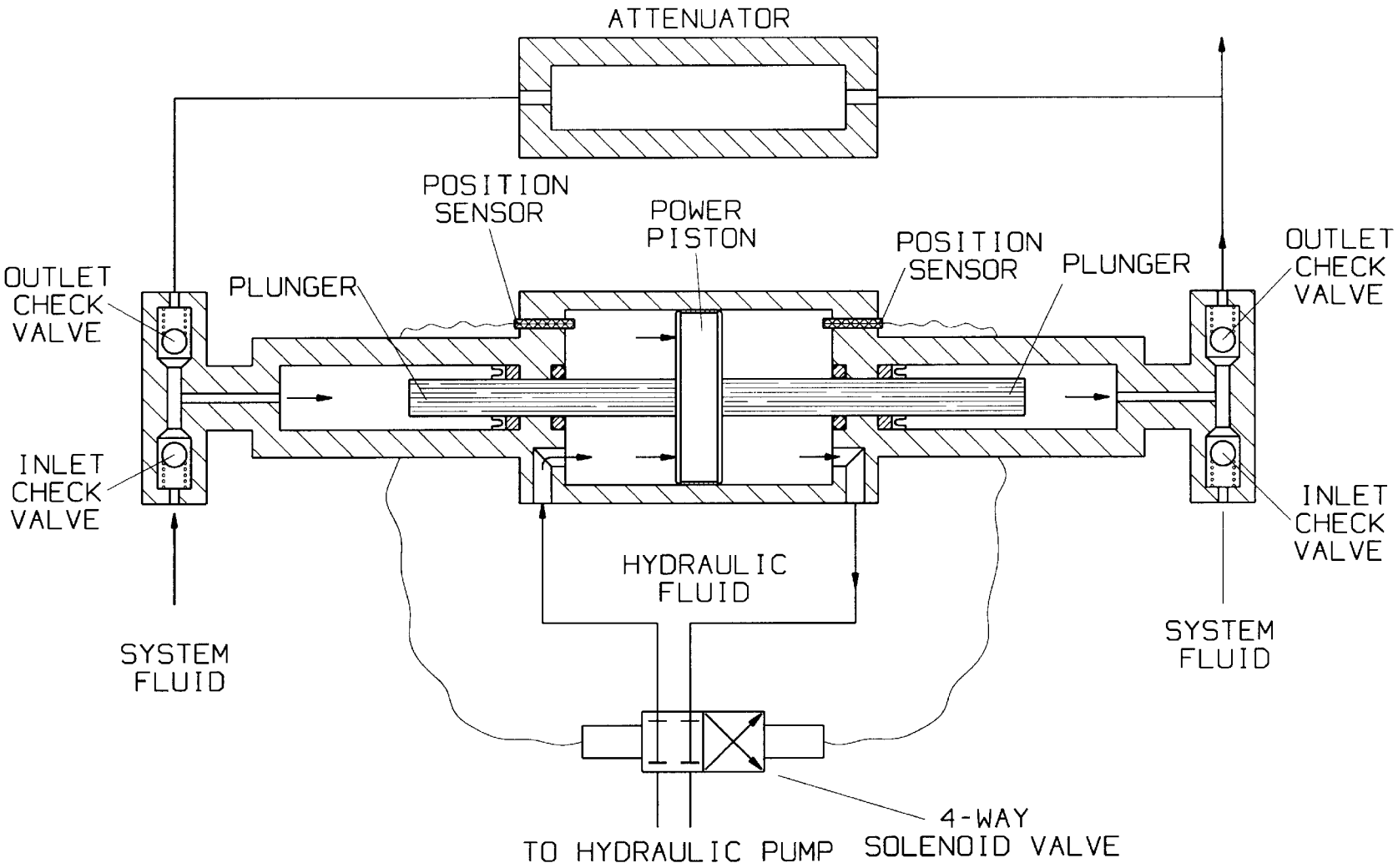
FIG. 2 (PRIOR ART)
FIG. 2 is a partial cross-sectional schematic diagram of a conventional fluid pressure intensifier.
Figure 3:
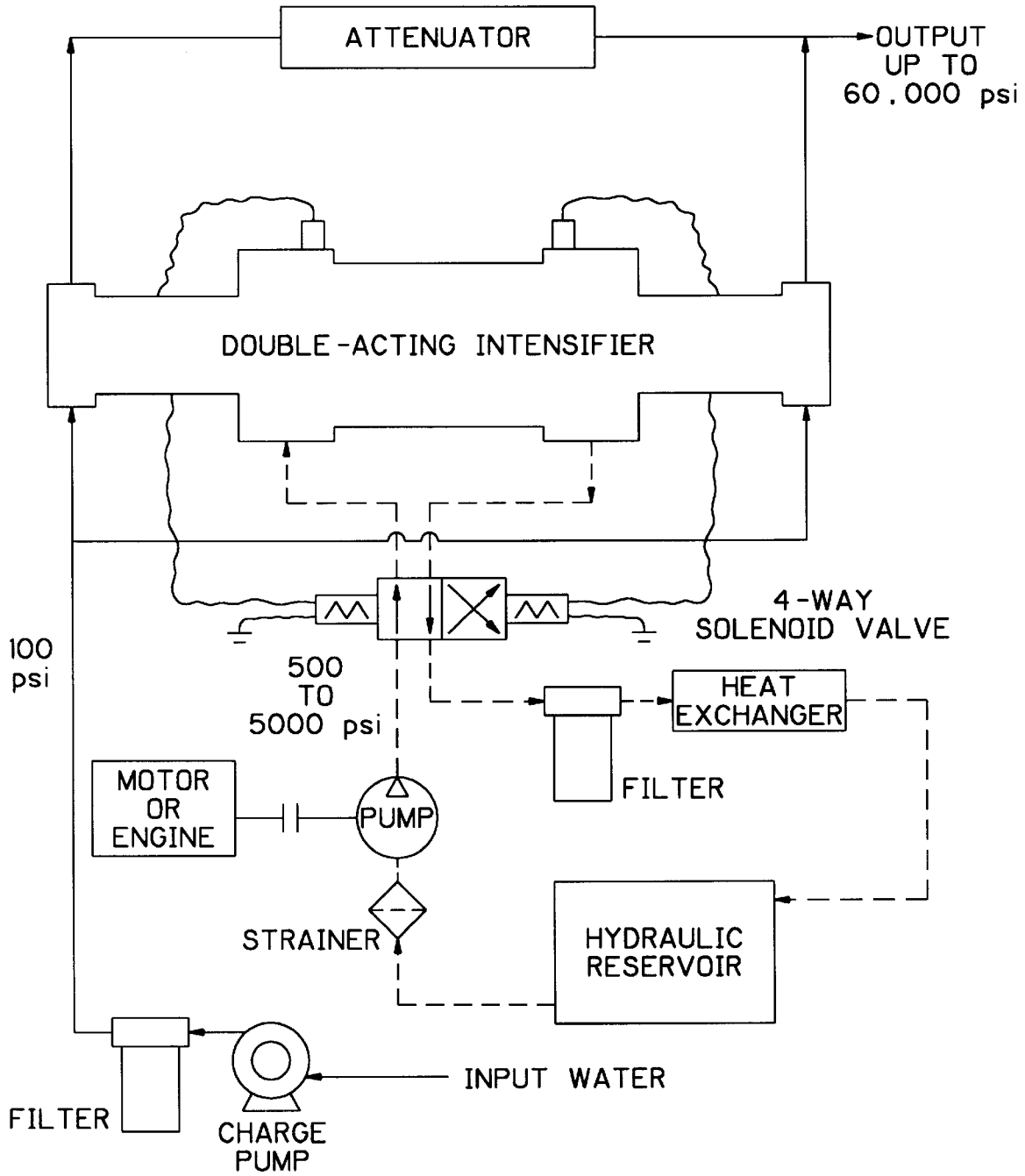
FIG. 3 (PRIOR ART)
FIG. 3 is a schematic diagram of a conventional double-acting pressure intensifier system.

Because the pressure intensifier according to different embodiments of this invention preferably but not necessarily has three or more cylinders working together to provide two or more power strokes at any given time, the output flow and pressure of the waterjet system according to this invention can be extremely smooth and without pressure fluctuations commonly found in conventional high-pressure pumps. According to the pressure intensifier of this invention, there is no need for an external pulsation attenuator. Comparing FIG. 15 to FIG. 3, it is apparent that the fluid power system according to this invention does not require a solenoid-operated 4-way valve and the fluid power system according to this invention requires no power piston position sensor and/or associated circuit. The absence of such conventional system components commonly found in available waterjet systems significantly simplifies the piping system and also results in a system that is much smoother with reduced noise and shock and is also less expensive to construct.

Rotary intensifier 501, according to different embodiments of this invention, has other advantageous features. For example, rotary intensifier 501 has an ability to accept a wider ranger of power inputs. Although rotary intensifier 501 of this invention, once constructed, has fixed maximum stroke lengths, the reciprocating rate can be increased to a level considerably higher than that possible with conventional pressure intensifiers, due to much reduced mass and inertia of internal moving parts. For example, a conventional double-acting pressure intensifier having a 20 hp power input can have a 3.5 inch diameter power piston and 0.75 inch diameter plungers, and such conventional intensifiers are typically operated at a maximum reciprocating rate of about 60 rpm. A comparable pressure intensifier according to this invention has 1.125 inch diameter power pistons and 0.375 inch diameter plungers, and can be operated at reciprocating rates of greater than 120 rpm, at a power input of greater than 30 hp. One advantage in power capability of pressure intensifiers according to this invention is noticeable at greater power levels, such as above about 50 hp. Smaller internal parts used in the pressure intensifiers according to this invention results in cost savings through reduction of materials and machine time. Smaller parts can be constructed with greater precision and are less expensive to replace.

Another advantage of rotary intensifier 501 according to this invention is the operational simplicity. Because electronic sensors are not used, rotary intensifier 501 according to this invention is well suited for remote fluid-jet applications, such as in mining, tunneling, drilling and underwater geotechnical operations. The pressure intensifiers according to this invention can be integrated with rotary drill or other mechanical systems for use under hostile conditions. Conventionally available fluid pressure intensifiers cannot be easily adapted for such applications, due to geometrical and operational restrictions. For example, currently available single-acting or double-acting pressure intensifiers are too bulky for inserting into a casing of an oil well, which is usually less than about six inches in diameter. Also, conventionally available pressure intensifiers require electronic sensors. When working with high-pressure fluid jets for servicing gas wells and oil wells, a suitable pump must be available for operations within a well casing. Down-hole pumps must be fluid operated with a fluid supply from the ground surface, with a working fluid pressure below about 10,000 psi and must also be able to raise the pressure of a system fluid to above about 30,000 psi, so as to generate useful fluid jets to cut, perforate and fracture rock. Rotary intensifiers according to this invention are potentially suited for down-hole applications. In mining operations, high-pressure waterjets are known as an ideal tool for drilling holes in rock and for fracturing rock. However, to be very useful the waterjet drill head must be remotely operated, away from a work station without the use of a long high-pressure hose that is relatively stiff, expensive and prone to leakage. The pressure intensifiers according to this invention allow the high-pressure pump to be located close to the nozzles and to minimize the need for high-pressure hoses. A similar situation exists in underwater waterjet applications, wherein the pump is positioned near nozzles, so as to eliminate a need for relatively long high-pressure hoses. With the pressure intensifiers according to this invention, ordinary hydraulic hoses operating at ordinary hydraulic pressures of about 5,000 psi or less can be used.

EXAMPLE 1

In one example according to a preferred embodiment of this invention, a 10 hp hydraulically-powered fluid pressure intensifier system was constructed and used for waterjet operations. The hydraulic power pack of such system was constructed with commercially available components, including a 10 hp electric motor, a pressure-compensated axially piston pump, a hydraulic filter cartridge, a 20 gallon hydraulic reservoir, a water-oil heat exchanger, a check valve for oil flow from the pump, and necessary hoses and tubes. The hydraulic power pack was fitted with a dual cartridge water filtration system, a water charge pump, and necessary gauges and valves. The rotary intensifier was constructed according to this invention and used a valve constructed according to the valve shown in FIGS. 10 and 11, having six oscillating valve rods 405.

The rotary intensifier was 4.5 inches in overall diameter and about 24 inches in overall length. The rotary intensifier comprised five cylindrical portions and an end coupling cylinder. The five cylinders were constructed of stainless steel and were bolted together with six 0.5 inch diameter tie rods. The valve cylinder had a 2.0 inch diameter cavity housing, a six rod rotary valve with a face similar to slanted face 418 shown in FIG. 10, as well as a 0.5 inch shaft extending out of an end cap and into an end coupling cylinder whereby rotor shaft 408 was connected to the shaft of a small hydraulic motor, with a shaft coupler.

The hydraulic motor was connected to the hydraulic power pack through relatively small hoses. The rotary intensifier had six cylindrical power chambers, each housing a power piston of 1.125 inches in diameter. The power piston was attached to a 0.375 inch diameter plunger constructed of hardened stainless steel. The stroke length of such piston-plunger assemblies was 3 inches maximum. The high-pressure chambers had a diameter of 0.750 inches and housed cylindrical spacers to support inlet check valve disks, as shown in FIG. 12, and as later described. Poppet type outlet check valves, such as those taught by U.S. Pat. No. 5,241,986, were also employed. The gas chamber of the intensifier was filled with nitrogen to a pressure of about 250 psi and such gas was routed to the oil-distributing rotary valve to provide a bias force to the six valve rods 405. Water was routed to the intensifier from a source operating at about 70 psi and was filtered with 200-micron and then 5-micron fibrous filter cartridges.

When the power was turned on, hydraulic oil flowed into the rotary intensifier at a rate of about 4 gallons per minute. Hydraulic oil also flowed into the hydraulic motor and caused valve rotor 403 to rotate. The rotational speed of valve rotor 403 was controlled by the pressure and flow rate of the hydraulic oil into the hydraulic motor. By adjusting flow parameters with a valve, the hydraulic motor was set at about 60 rpm. The majority of the hydraulic oil flowed into the intensifier. At 3,000 psi oil pressure and with about a 0.009 inch diameter orifice placed at the waterjet nozzle, the output water pressure was about 25,000 psi, indicating a pressure intensification ratio of about 8.3:1. The output water pressure was essentially constant and devoid of violent fluctuations commonly observed with conventional high-pressure pumps that do not have external pulsation attenuators. The rotary intensifier of this invention functioned smoothly, without loud hydraulic shocks associated with the shifting of 4-way hydraulic valves used in conventional double-acting intensifiers. The nearly continuous flow of hydraulic oil according to the pressure intensifier of this invention was beneficial to longevity of the hydraulic pump.

While in the foregoing specification this invention has been described in relation to certain preferred embodiments thereof, and many details have been set forth for purpose of illustration, it will be apparent to those skilled in the art that this invention is susceptible to additional embodiments and that certain of the details described herein can be varied considerably without departing from the basic principles of this invention.

I claim:

1. A high-pressure valve assembly comprising:

a valve body, an inner wall of said valve body at least partially forming a valve cavity, isolation means for at least partially dividing said valve cavity into a power chamber and a discharge chamber, said valve body having an inlet in communication with said power chamber and an outlet in communication with said discharge chamber, said valve body having a plurality of valve ports;

a valve rotor rotatably mounted within said valve cavity, rotation means for rotating said valve rotor with respect to said valve body;

in a working position of said valve rotor said power chamber communicating with said inlet and a first valve port of said valve ports and said discharge chamber communicating with said outlet and a second valve port of said valve ports;

said isolation means comprising a valve rod cage mounted within said valve cavity, said valve rod cage having a plurality of valve rod holes, a plurality of elongated valve rods, each said valve rod slidably mounted within a corresponding said valve rod hole, each of said valve rods having a rod cutout area, said valve rod cage forming said power chamber as an annular power cutout area in communication with at least two of said valve rod holes, said valve rod cage forming said discharge chamber as an annular discharge cutout area in communication with at least two of said valve rod holes, said valve rod cage forming said valve ports which correspond to and communicate with said valve rod holes;

oscillation means for oscillating said valve rods in an axial direction within said valve rod holes so that during an oscillation cycle at least a first one of said valve rods is positioned to form communication between said power cutout area and said rod cutout area of said first one and simultaneously prevent communication between said discharge cutout area and said rod cutout area of said first one and at least a second one of said valve rods is positioned to form communication between said discharge cutout area and said rod cutout area of said second one and simultaneously prevent communication between said power cutout area and said rod cutout area of said second one, said valve rotor having a slanted face, and bias means for urging a round end of each of said valve rods against said slanted face; and a power cylinder body sealably secured with respect to said valve body, said power cylinder body having a plurality of power chambers in a number corresponding to said valve ports, a power piston slidably mounted within each said power chamber, and said power chambers in communication with corresponding said valve ports.

2. In a high-pressure valve assembly according to claim 1 further comprising a plurality of plunger shafts, and each said plunger shaft longitudinally fixed with respect to a corresponding power piston of said power pistons.

3. In a high-pressure valve assembly according to claim 2 further comprising a high-pressure cylinder body sealably secured with respect to said power cylinder body, said high-pressure cylinder body having a plurality of high-pressure chambers in a number corresponding to said power pistons, and each said power piston slidably mounted within a corresponding said high-pressure chamber.

4. In a high-pressure valve assembly according to claim 3 wherein said high-pressure cylinder body, said power cylinder body and said valve body are longitudinally aligned.

5. In a high-pressure valve assembly according to claim 3 further comprising distribution means for introducing a system fluid into each of said high-pressure chambers during an intake stroke of a corresponding said power piston and for discharging said system fluid from each of said high-pressure chambers during a discharge stroke of a corresponding said power piston.

6. In a high-pressure valve assembly according to claim 5 wherein said distribution means comprise: said high-pressure chamber having a reservoir, at least one check valve mounted with respect to said high-pressure cylinder, said at least one check valve forming communication between at least one of said high-pressure chambers during said discharge stroke and preventing communication between said at least one of said high-pressure chambers during said intake stroke.

7. In a high-pressure valve assembly according to claim 6 wherein said distribution means forms communication between said high-pressure chamber and a system fluid source during said intake stroke.

* * * * *